US005084312A

United States Patent [19]

Krikorian et al.

[11] Patent Number: 5,084,312

[45] Date of Patent: Jan. 28, 1992

[54] MOLTEN METAL CONTAINMENT VESSEL WITH RARE EARTH OXYSULFIDE PROTECTIVE COATING THEREON AND METHOD OF MAKING SAME

[75] Inventors: Oscar H. Krikorian, Danville; Paul G. Curtis, Tracy, both of Calif.

[73] Assignee: United States Department of Energy, Washington, D.C.

[21] Appl. No.: 420,488

[22] Filed: Oct. 12, 1989

[51] Int. Cl.[5] ..... F27B 14/10; C21B 7/00

[52] U.S. Cl. ..... 428/35.8; 266/275; 266/282; 266/286; 220/454; 432/265

[58] Field of Search ..... 428/35.8; 220/454, 455, 220/456; 266/39, 43, 275, 282, 286; 432/264, 265

[56] References Cited

U.S. PATENT DOCUMENTS 3,734,480 5/1973 Zanis et al. ..... 266/39

OTHER PUBLICATIONS

Journal of the American Ceramic Society, vol. 34, No. 4, pp. 128-135. Eastman, Brewer, Bromley, Gilles, Lofgren.

*Primary Examiner*—James J. Seidleck
*Assistant Examiner*—Charles R. Nold
*Attorney, Agent, or Firm*—L. E. Carnahan; Roger S. Gaither; William R. Moser

[57] ABSTRACT

An improved molten metal containment vessel is disclosed in which wetting of the vessel's inner wall surfaces by molten metal is inhibited by coating at least the inner surfaces of the containment vessel with one or more rare earth oxysulfide or rare earth sulfide compounds to inhibit wetting and or adherence by the molten metal to the surfaces of the containment vessel.

15 Claims, 2 Drawing Sheets

MOLTEN METAL CONTAINMENT VESSEL WITH RARE EARTH OXYSULFIDE PROTECTIVE COATING THEREON AND METHOD OF MAKING SAME

BACKGROUND OF THE INVENTION

The invention described herein arose in the course of, or under, Contract No. W-7405-ENG-48 between the United States Department of Energy and the University of California.

This invention relates to a an improved containment vessel for certain molten metals and a method of making same. More particularly, this invention relates to an improved containment vessel for molten metals formed by coating at least the inside surface of a containment vessel with an oxysulfide or sulfide of a rare earth or rare earth-like element.

Molten metals such as uranium, plutonium, aluminum, and calcium are usually contained in vessels or crucibles made from graphite or a refractory metal such as, for example, niobium, tantalum, molybdenum, or tungsten. Often, however, such molten metals wet the surface of the refractory metal containment vessel which results in the molten metal adhering to the walls of the containment vessel as it cools, causing distortion of the containment vessel and sometimes resulting in breakage of the containment vessel.

Often, also, the molten metals react chemically with the containment vessel and dissolve wall materials, thus resulting in corrosion of the containment vessel, and contamination of the melt with impurities.

It has been previously proposed to line such vessels with a material which is chemically inert to such molten metals and which is not easily wetted or chemically attacked by such molten metals. For example, Marden et al. U.S. Pat. No. 1,704,257 teaches the reduction of a compound such as uranium oxide by mixing it with a reducing agent and a fluxing agent and placing it in a metal bomb which has been lined with calcium oxide to prevent the reduced material from interacting with the metal walls of the bomb during the reduction reaction Bone et al. U.S. Pat. No. 2,858,596 also describes the reduction of uranium in a metal vessel lined with a very dense calcium oxide to prevent impurities from reaching the reduced uranium.

Anderson et al. U.S. Pat. No. 3,023,119 discloses that MgO and $Al_2O_3$ have been previously used as linings when handling molten plutonium in a metal or graphite mold. Anderson suggests instead the use of a $CaF_2$ as a lining for either metal or nonmetal crucibles used as molds for molten plutonium. Campbell U.S. Pat. No. 3,035,318 also teaches the use of a $CaF_2$ lining for use in the casting of uranium and plutonium; while Huet et al. U.S. Pat. No. 3,227,433 describes the use of $CaF_2$ as a refractory material to line the walls of a vessel used for the reduction of uranium tetrafluoride by calcium.

Asbury U.S. Pat. No. 3,890,140 discloses the use of aluminum titanate ($Al_2TiO_3$ or $Al_2O_3TiO_3$) as a crucible or crucible lining for molten uranium and uranium alloys, while Hulsey U.S. Pat. No. 3,915,695 describes the use of a zirconia-lined graphite crucible in the melting of uranium metal chips.

However, the use of such materials to prevent contact between the molten metal and the underlying crucible material usually results in the need to use thicker layers or linings due to the tendency of some of these materials to dissolve or react with the molten metal. These interactions also lead to contamination of the melt. Furthermore, some of these materials are temperature limited and some tend to be hygroscopic in nature requiring special handling to avoid exposure to moisture.

It would, therefore, be beneficial to provide a modified or improved containment vessel wherein molten metals in the containment vessel would not wet or adhere to the surfaces of a containment vessel without the need for thick linings of materials which may be temperature sensitive, or hygroscopic, or which may tend to react or dissolve in the molten metal.

SUMMARY OF THE INVENTION

It is, therefore, an object of this invention to provide an improved molten metal containment vessel in which wetting of the surfaces by molten metal is inhibited.

It is another object of this invention to provide an improved molten metal containment vessel in which wetting of the surfaces by molten metal is inhibited by coating the surfaces of at least the inner walls of the containment vessel with one or more compounds which will inhibit such wetting and or adherence by the molten metal.

It is yet another object of this invention to provide an improved molten metal containment vessel in which wetting of the surfaces by molten metal is inhibited by coating the surfaces of at least the inner walls of the containment vessel with one or more sulfide compound which will inhibit such wetting and or adherence by the molten metal.

It is yet another object of this invention to provide an improved molten metal containment vessel in which wetting of the vessel's surfaces by molten metal is inhibited by coating the surfaces of at least the inner walls of the containment vessel with one or more compounds comprising an oxysulfide of a rare earth or a rare earth-like element to inhibit such wetting and or adherence by the molten metal.

It is a further object of this invention to provide a method for making an improved molten metal containment vessel in which wetting of the surfaces by molten metal is inhibited which comprises coating the surfaces of at least the inner walls of the containment vessel with one or more compounds which will inhibit such wetting and or adherence by the molten metal.

These and other objects of the invention will be apparent from the following description and accompanying drawings.

DETAILED DESCRIPTION OF THE INVENTION

Figure 2:
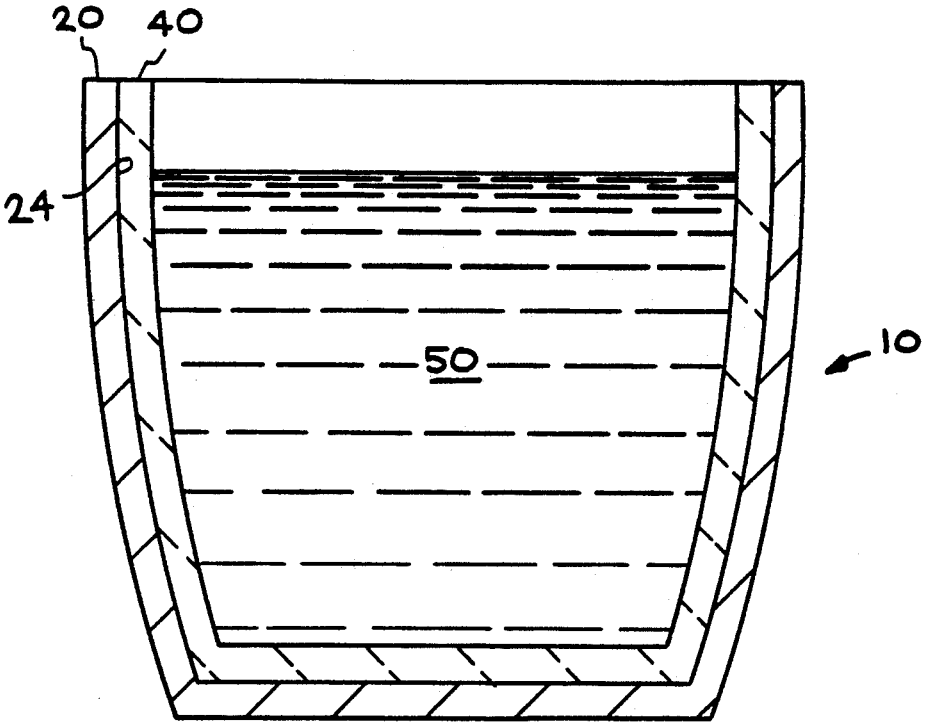
FIG. 2 is a vertical cross-section view of an improved containment vessel constructed in accordance with one embodiment of the invention.

Referring now to FIG. 2, a containment vessel for molten metal is generally shown at 10 comprising an outer wall or shell 20 and an inner coating layer 40. A molten metal 50 is shown contained within vessel 10.

Outer wall 20 of containment vessel 10 may comprise a Group Va metal such as vanadium, niobium, or tantalum or, in one embodiment, a Group IVa metal such as titanium or zirconium. Outer wall 20 may also comprise graphite. As will be discussed in more detail in connection with another embodiment below, other materials may also be used to form outer wall 20 when an intermediate layer is formed over layer 20.

In accordance with the invention, coating compound layer 40 of the invention may comprise a sulfide compound of a rare earth element, or a mixture of such compounds, which is capable of being applied to the surface of outer metal wall 20 of containment vessel 10. The sulfide compound, or mixture of compounds, usually has the formula $R_kO_mS_n$ where R is a rare earth element; k is an integer having a value of 1, 2, or 4; m is an integer having a value of 1 when k is 1, either 2 or 0 when k is 2, and 4 when k is 4; and n is an integer having a value of from 1 to 3. Preferably, m is 2 when k is 2 and the compound or compounds each comprises an oxysulfide of a rare earth element.

Examples of rare earth elements which may be used in forming the rare earth oxysulfide or sulfide compound include the lanthanide elements La, Ce, Pr, Nd, Sm, Eu, Gd, Tb, Dy, Ho, Er, Tm, Yb, Lu; as well as the rare earth-like elements Sc and Y; and actinides such as Th and U. The term "rare earth" and "rare earth elements", as used herein, are therefore intended to define any of the above listed elements.

The rare earth oxysulfide and sulfide coatings of the invention may be formed on at least the inner surface 24 of outer metal wall 20 by any method capable of forming a coating layer ranging from about 2 to about 250 microns, preferably from at least about 4 to about 20 microns, in thickness. Thicker layers of coating layer 40 may be formed if desired but are deemed unnecessary for the intended purpose.

Examples of methods which may be used to apply coating layer 40 to at least inner surface 2 of outer metal layer or shell 20 include both physical vapor deposition and sputtering. While a physical vapor deposition method may be preferred for forming the coating of the invention, due to its simplicity and lower cost, deposition of the coating by sputtering techniques, particularly for large scale operations, may be preferred in some instances due to the preliminary surface cleaning step and the high energy impact of the coating materials on the surface of the containment vessel in a sputtering method, both of which may result in better adherence of the coating.

The coating material may also be applied to the container wall by a slurry method or technique, for example, in coating the walls of a graphite container with CeS by slurrying the coating material in an organic carrier and applying it to the container wall surface followed by firing to a high temperature.

Molten metals which may be used in containment vessels constructed in accordance with the invention will include any metal which, when molten, will not chemically react with the coating of the invention and which will not wet the surface of the coating material. Examples of such metals may include aluminum, uranium, iron, cobalt, nickel, calcium, magnesium, zinc, lithium, sodium, plutonium, and their alloys.

Figure 1:
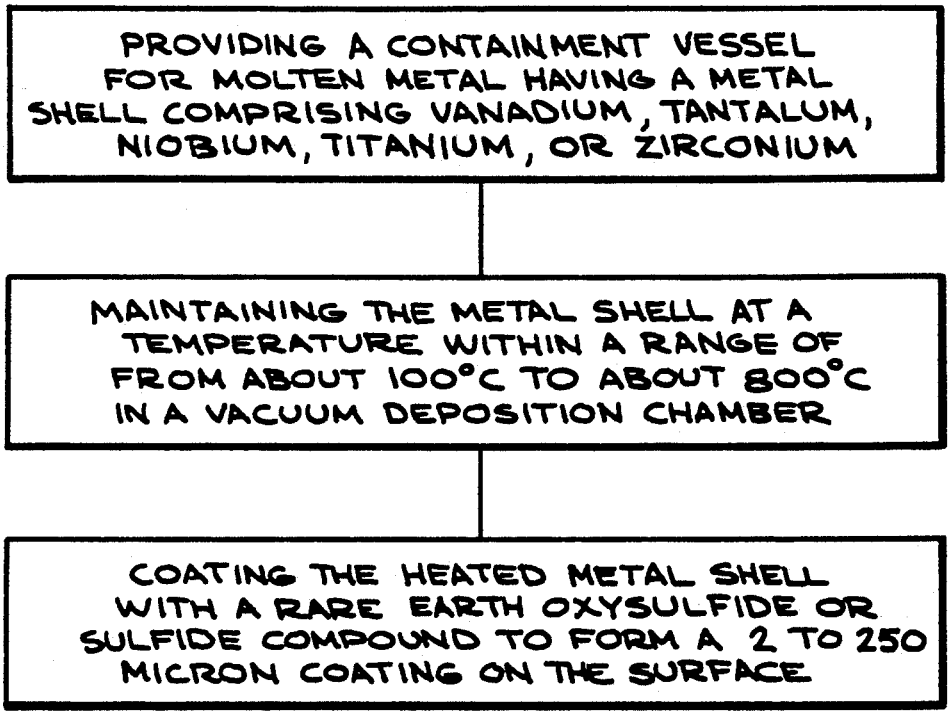
FIG. 1 is a flow sheet illustrating the process of the invention.
Figure 3:
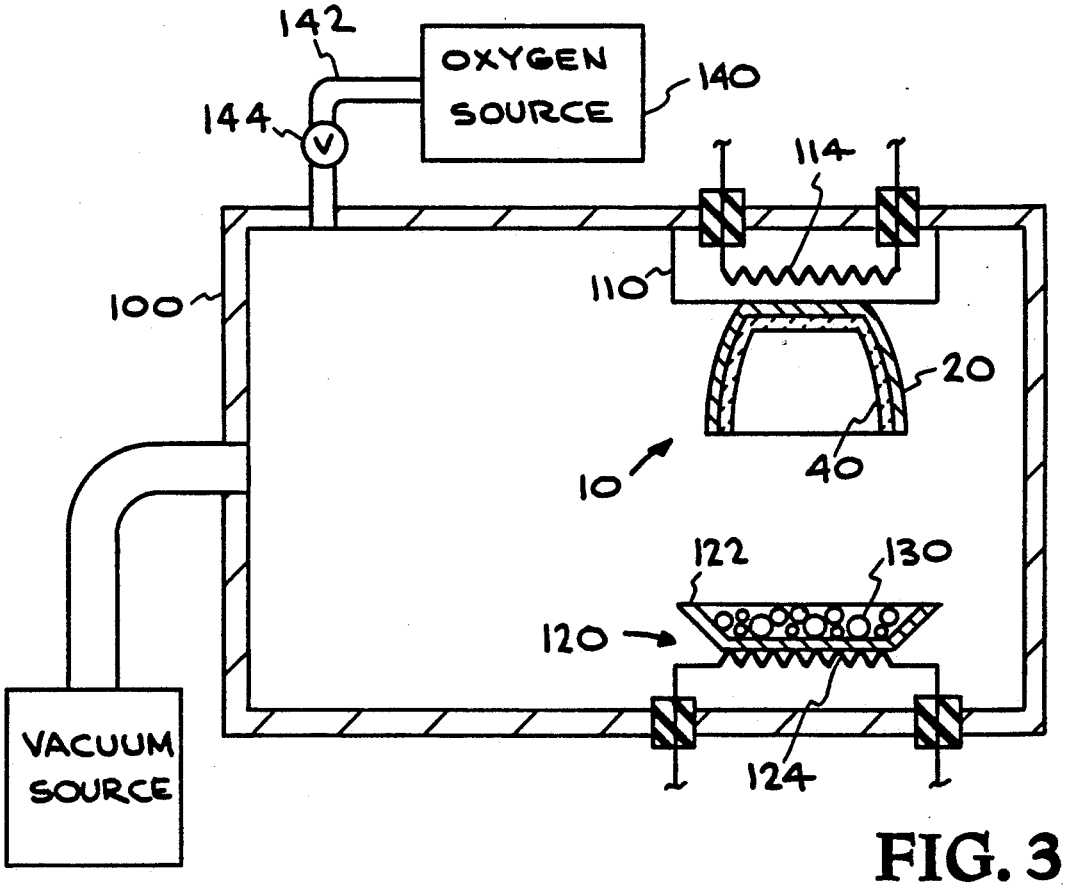
FIG. 3 is a diagrammatic view of apparatus suitable for vapor deposition of an oxysulfide compound onto the surface of a containment vessel.

Turning now to FIG. 3, formation of protective rare earth oxysulfide layer 40 by physical vapor deposition is illustrated wherein a molten metal containment vessel shell 20, such as a vanadium crucible, is placed in a deposition chamber 100 and is suitably attached to a support base 110. Base 110 further comprises heater means 114 for heating metal shell 20 to a temperature within a range of from about 100° C. to about 800° C., preferably from about 200° C. to about 450° C.

Also provided in deposition chamber 100 is a vaporization station 120 comprising a base or receptacle 122 on or in which is placed one or more rare earth sulfide materials 130 to be vaporized. Below receptacle 122 is a tungsten filament heating means 124 capable of heating the rare earth sulfide up to as high as about 2000° C. to vaporize rare earth sulfide material 130. The rare earth sulfide material 130 may also be placed directly on the tungsten filament heater 124 without the use of receptacle 122.

A source of oxygen 140, which is connected to deposition chamber 100 through a pipe 142 and a valve 144, provides oxygen for the reaction which takes place on at least the inner surface 24 of shell 20 in which the oxygen reacts with the rare earth sulfide vapors to form the rare earth oxysulfide coating of the preferred embodiment of the invention. The oxygen may be allowed to flow into apparatus 100 at a rate which will permit a vacuum of from about 1 to $5\times10^{-4}$ Torr to be maintained in the chamber while providing a sufficient amount of oxygen for the reaction. Usually a flow rate of from about 0.01 to about 0.1 Torr-liters/second or from about $3\times10^{-5}$ to $3\times10^{-4}$ atm-ft$^3$/minute, depending upon the capacity of the vacuum pump means, will provide sufficient oxygen while allowing the desired pressure to be maintained.

The deposition reaction, which deposits about 0.5 microns per minute, is allowed to proceed until the desired coating thickness of rare earth oxysulfide has been formed on surface 24 of shell 20 to form containment vessel 10. Typically to form a 15 micron thick coating of rare earth oxysulfide on surface 24 of shell 20, the physical vapor deposition reaction is allowed to proceed from about 10 to about 120 minutes, preferably for about 30 minutes.

It should be noted that while heating means 124 has been illustrated as a tungsten filament heater, other heating means may be used to vaporize the rare earth sulfide compound such as, for example, an electron beam (E gun) heater. The term "physical vapor deposition", as used herein, is therefore intended to include any heating means which may be used to form a rare earth sulfide vapor which then may react with oxygen gas (when present) at surface 24 of heated metal shell 20 to form the desired rare earth oxysulfide coating.

The phrase "when present", used above in connection with the description of the reaction of the oxygen gas with the rare earth sulfide vapors at surface 24 of metal shell 20, is intended to distinguish the presence of such oxygen gas in deposition chamber 100, when it is desired to form a rare earth oxysulfide coating in accordance with the preferred embodiment of the invention, from the absence of oxygen gas, in which case a rare earth sulfide coating will be deposited on surface 24.

The deposition of a rare earth oxysulfide coating is preferred over a rare earth sulfide coating due to the higher temperatures which may be used in vessels having rare earth oxysulfides coatings thereon rather than rare earth sulfide coatings.

For example, a vanadium containment vessel which includes a coating of cerium oxysulfide thereon has been found to be capable of withstanding molten uranium at a temperature of 1200° C. without wetting or reaction between the uranium and the coating while a similar vessel formed from niobium and coated with cerium oxysulfide withstood molten uranium at a temperature of over 1330° C. without wetting or reaction. In contrast, uranium, at temperatures exceeding 1180° C., will wet the surface of a rare earth sulfide coating such as, for example, cerium monosulfide (CeS).

However, the formation of a containment vessel having a coating thereon of one or more rare earth sulfides should be deemed to be within the scope of the invention as would be a coating comprising a mixture of one or more rare earth oxysulfides with one or more rare earth sulfides.

It should also be noted that while th formation of a coating layer of one or more of such rare earth oxysulfides and/or sulfides over a metal shell or vessel comprises the preferred embodiment of the invention, it is also possible to fabricate such a containment vessel wholly from such rare earth oxysulfide or sulfide materials and such should be deemed to be within the scope of the invention. However, due to the brittleness and low resistance to thermal shock of such materials when used in bulk, the use of such materials as coating materials over another base material is preferred.

Figure 4:
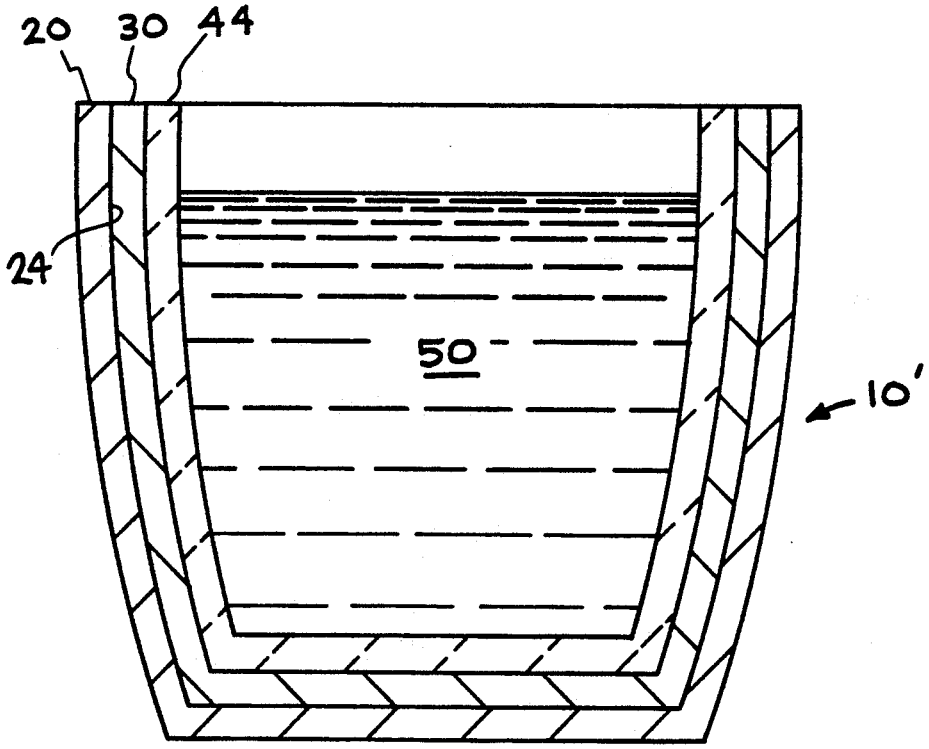
FIG. 4 is a vertical cross-section view of an improved containment vessel constructed in accordance with another embodiment of the invention.

Turning now to FIG. 4, another embodiment of the invention is shown wherein an intermediate layer 30 is shown formed over the inner surface of outer metal shell 20 prior to formation of rare earth sulfide layer 44 to form containment vessel 10'. The purpose of intermediate layer 30 is to permit the use of other materials such as steel and stainless steel for metal shell 20 while providing better adherence to metal shell 20 and better thermal expansion matching than would be possible if the rare earth sulfide coating material were to be applied directly to the steel or stainless steel surface.

Examples of metals which may be used to form intermediate layer 30 include chromium, titanium, and vanadium. For example, when outer metal shell 20 is formed from stainless steel, an intermediate layer 30 of chromium may be formed over stainless steel shell 20 to provide better adherence and thermal matching between the stainless steel shell and the rare earth sulfide coating. Intermediate layer 30 may range in thickness from about 1 to about 10 microns. Intermediate layer 30 may be formed over metal shell 20 by any convenient method, including plating, cladding, or vapor deposition.

It should be noted, however, that in some instances, such as the use of chromium as intermediate layer 30, the formation of a rare earth sulfide coating over the chromium intermediate layer will be preferred over a rare earth oxysulfide coating on the intermediate metal layer because of the superior adherence of the rare earth sulfide to the chromium layer.

After formation of intermediate layer 30 over metal shell 20, rare earth sulfide layer 44 may be applied over intermediate layer 30 in the same manner as previously discussed with regard to the first embodiment of the invention.

By way of illustration of the invention, four vanadium crucibles were each coated with a 4 micron layer of cerium oxysulfide ($Ce_2O_2S$) and four vanadium crucibles were similarly coated with an 8 micron layer of cerium oxysulfide applied over the inner surfaces of the vanadium crucibles by physical vapor deposition in a vacuum chamber where cerium sulfide was heated to a temperature of about 1900° C. using a tungsten filament boat heater to vaporize the cerium sulfide. The chamber was maintained at a vacuum containing oxygen as the dominant residual gas at a pressure of about 1 to $5\times10^{-4}$ Torr and the crucibles were each maintained at a temperature of about 350° C. during the depositions. In each case, oxygen gas was flowed into the chamber at a rate of about 0.03 Torr-liters/second. In the 4 micron thick coating cases the deposition was carried out for about 30 minutes, and in the 8 micron thick coating cases for about 60 minutes, after which the crucibles were respectively removed from the deposition chamber and allowed to cool.

Two of the 4 micron thick coated crucibles and two of the 8 micron thick coated crucibles were each filled with a uranium ingot and two 4 micron thick coated crucibles were each filled with a 95 wt. % uranium/5 wt. % chromium ingot. The uranium-containing crucibles were then heated to 1200° C. under vacuum for 1 hour each and the 95 wt. % uranium/5 wt. % chromium-containing crucibles were heated to 1250° C. under vacuum for 2 hours each. The crucibles were then allowed to cool, the ingots removed, and the surfaces of the coatings examined for traces of the molten contents which would indicate wetting of the cerium oxysulfide surfaces. No traces of wetting were observed nor were there any visible evidences of chemical attack of either the ingots or the cerium oxysulfide surfaces.

The uranium and uranium/chromium materials which had been in the respective crucibles were then analyzed by metallography for impurities which would indicate chemical attack of the cerium oxysulfide surfaces. No traces of such impurities were found, verifying the chemical inertness of the coating material of the invention to the molten contents of the crucibles.

The remaining two of the 8 micron thick coated crucibles were each filled with a plutonium ingot, and each heated to 1100° C. under vacuum for 2 hours and then cooled. Visual examination again showed no trace of wetting or evidence of chemical attack of either of these ingots or of the cerium oxysulfide coating surfaces.

Similar results were obtained using niobium crucibles instead of vanadium crucibles, using either cerium oxysulfide ($Ce_2O_2S$) or yttrium oxysulfide ($Y_2O_2S$) as the coating material.

Thus, the invention provides an improved molten metal containment vessel for the containment of a molten metal and a method of making same by forming a protective coating layer of one or more rare earth oxysulfide compounds or rare earth sulfide compounds over at least the inner surface of the metal containment vessel which coating is neither chemically attacked nor wetted by molten metal subsequently loaded into the containment vessel.

While a specific embodiment of the coated molten metal containment vessel of the invention has been illustrated and a method described for making the coated molten metal containment vessel in accordance with this invention, modifications and changes of the apparatus, parameters, materials, etc. will become apparent to those skilled in the art, and it is intended to cover in the appended claims all such modifications and changes which come within the scope of the invention.

What is claimed is:

1. An improved molten metal containment vessel having superior nonwetting and nonreactive characteristics when exposed to molten metal, said vessel having a coating thereon consisting essentially of an oxysulfide compound of one or more rare earth elements having the formula $R_2O_2S$ where R is a rare earth element.

2. The containment vessel of claim 1 wherein said vessel further comprises a metal shell selected from the class consisting of vanadium, tantalum, niobium, titanium, and zirconium coated with said coating material on the surfaces of at least the inner walls of said containment vessel.

3. The containment vessel of claim 1 wherein said vessel further comprises a metal shell selected from the class consisting of vanadium, tantalum, and niobium coated with said coating material.

4. The containment vessel of claim 1 wherein the thickness of said coating is within a range of from about 2 to about 250 microns.

5. The containment vessel of claim 4 wherein the thickness of said coating is within a range of from about 4 to about 20 microns.

6. The containment vessel of claim 1 wherein said rare earth element is selected from the class consisting of La, Ce, Pr, Nd, Sm, Eu, Gd, Tb, Dy, Ho, Er, Tm, Yb, Lu, Sc, Y, Th, and U.

7. The containment vessel of claim 1 wherein said rare earth element is selected from the class consisting of La, Ce, Pr, Nd, Sm, Eu, Gd, Tb, Dy, Ho, Er, Tm, Yb, Lu, Sc, and Y.

8. An improved molten metal containment vessel having superior nonwetting and nonreactive characteristics when exposed to molten metal comprising a metal shell selected from the class consisting of vanadium, tantalum, niobium, titanium, and zirconium, said vessel having a rare earth oxysulfide coating thereon with a thickness within a range of from about 2 to about 50 microns comprising one or more rare earth oxysulfide compounds of one or more rare earth elements selected from the class consisting of La, Ce, Pr, Nd, Sm, Eu, Gd, Tb, Dy, Ho, Er, Tm, Yb, Lu, Sc, Y, Th, and U.

9. The containment vessel of claim 8 wherein said metal shell is selected from the class consisting of vanadium, tantalum, and niobium.

10. The containment vessel of claim 8 wherein the thickness of said coating is within a range of from about 4 to about 20 microns.

11. The containment vessel of claim 8 wherein said rare earth element is selected from the class consisting of La, Ce, Pr, Nd, Sm, Eu, Gd, Tb, Dy, Ho, Er, Tm, Yb, Lu, Sc and Y.

12. An improved molten metal containment vessel having superior nonwetting and nonreactive characteristics when exposed to molten metal comprising a metal shell selected from the class consisting of vanadium, tantalum, niobium, titanium, and zirconium, said vessel having a rare earth oxysulfide coating with a thickness of from about 4 to about 20 microns consisting essentially of one or more rare earth oxysulfide compounds having the formula $R_2O_2S$ where R is a rare earth element selected from the class consisting of La, Ce, Pr, Nd, Sm, Eu, Gd, Tb, Dy, Ho, Er, Tm, Yb, Lu, Sc, and Y.

13. An improved molten metal containment vessel having superior nonwetting and nonreactive characteristics when exposed to molten metal comprising a metal shell selected from the class consisting of vanadium, tantalum, and niobium having a rare earth oxysulfide coating thereon with a thickness within a range of from about 4 to about 20 microns comprising one or more rare earth oxysulfide compounds of one or more rare earth elements selected from the class consisting of La, Ce, Pr, Nd, Sm, Eu, Gd, Tb, Dy, Ho, Er, Tm, Yb, Lu, Sc, and Y.

14. The containment vessel of claim 13 wherein said rare earth oxysulfide coating comprises a cerium oxysulfide coating.

15. An improved molten metal containment vessel having superior nonwetting and nonreactive characteristics when exposed to molten metal comprising:

a) a metal shell selected from the class consisting of vanadium, tantalum, niobium, titanium, and zirconium; and b) a coating thereon consisting essentially of an oxysulfide compound of one or more rare earth elements selected from the class consisting of La, Ce, Pr, Nd, Sm, Eu, Gd, Tb, Dy, Ho, Er, Tm, Yb, Lu, Sc, and Y, formed by vaporizing one or more of the sulfides of said rare earth elements in the presence of oxygen in a vacuum deposition chamber containing said containment vessel to deposit the rare earth oxysulfide reaction product as a coating on said containment vessel.

* * * * *